US006886473B2

(12) United States Patent
Marchiori et al.

(10) Patent No.: US 6,886,473 B2
(45) Date of Patent: May 3, 2005

(54) RAIL CAR DOOR CLOSER

(75) Inventors: David P. Marchiori, San Antonio, TX (US); Melvin Gary Clark, Pipe Creek, TX (US)

(73) Assignee: Martin Marietta Materials Southwest, Ltd., San Antonio, TX (US)

( * ) Notice: Subject to any disclaimer, the term of this patent is extended or adjusted under 35 U.S.C. 154(b) by 0 days.

(21) Appl. No.: 10/649,692

(22) Filed: Aug. 28, 2003

(65) Prior Publication Data

US 2004/0040462 A1 Mar. 4, 2004

Related U.S. Application Data

(60) Provisional application No. 60/406,342, filed on Aug. 28, 2002.

(51) Int. Cl.[7] ..... B61D 5/00
(52) U.S. Cl. ..... 105/241.2
(58) Field of Search ..... 105/238.1, 241.1, 105/241.2, 286, 287, 288

(56) References Cited

U.S. PATENT DOCUMENTS

| | | | | | |
|---|---|---|---|---|---|
| 3,836,023 A | * | 9/1974 | Peterson et al. | ..... | 414/368 |
| 3,891,101 A | * | 6/1975 | Peterson | ..... | 414/387 |
| 4,011,956 A | * | 3/1977 | Green et al. | ..... | 105/241.2 |
| 4,120,412 A | | 10/1978 | Miller et al. | | |
| 4,235,169 A | | 11/1980 | Peterson | | |
| 4,329,106 A | | 5/1982 | Adler | | |
| 5,249,531 A | | 10/1993 | Taylor | | |
| 5,299,508 A | * | 4/1994 | Connelly | ..... | 105/241.2 |
| 5,302,072 A | | 4/1994 | Stauffer et al. | | |
| 5,419,262 A | * | 5/1995 | Turpin, Sr. | ..... | 105/241.2 |
| 5,601,032 A | | 2/1997 | Kosch | | |

OTHER PUBLICATIONS

PCT International Search Report dated Jul. 15, 2004 received in corresponding PCT application No. PCT/US03/26832 (references were already made of record in USSN 10/649,692).

* cited by examiner

*Primary Examiner*—S. Joseph Morano
*Assistant Examiner*—Robert J. McCarry, Jr.
(74) *Attorney, Agent, or Firm*—McDermott Will & Emery LLP

(57) ABSTRACT

A rail car door closer is provided and includes a movable base having a rotatable member rotationally disposed thereon. The movable base is coupled to a drive system configured to translate the movable base along a rail or a track disposed adjacent a railroad track rail. A device is also provided to permit securement of the rotatable member in a substantially upright position. When the rotatable member is in the substantially upright position, it is positioned vertically to contact an open rail car door and, upon movement of the movable base to a position adjacent and beneath the open rail car door, the rotatable member contacts the open rail car door and subsequently moves the open rail car door in correspondence with a movement of the movable base.

23 Claims, 14 Drawing Sheets

RAIL CAR DOOR CLOSER

Figure 1:
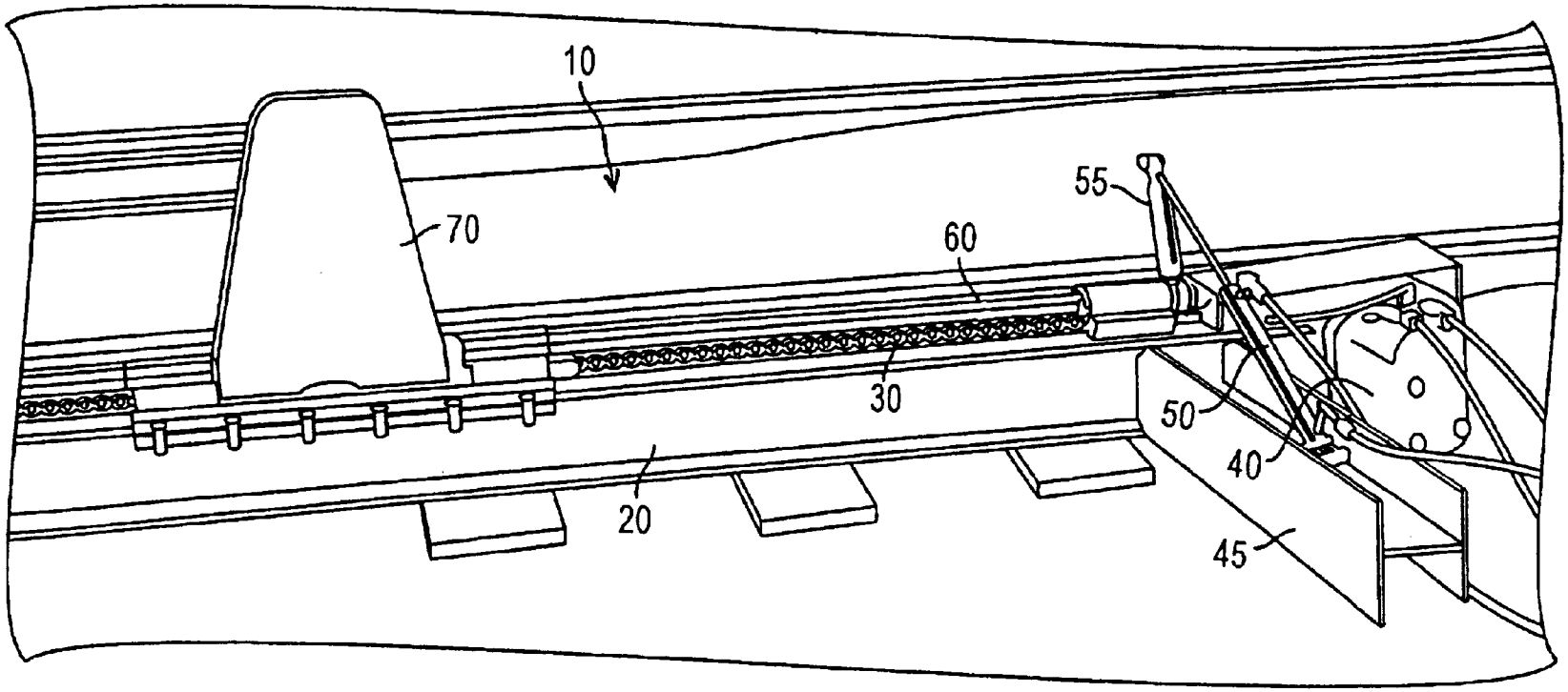
Figure 2A:
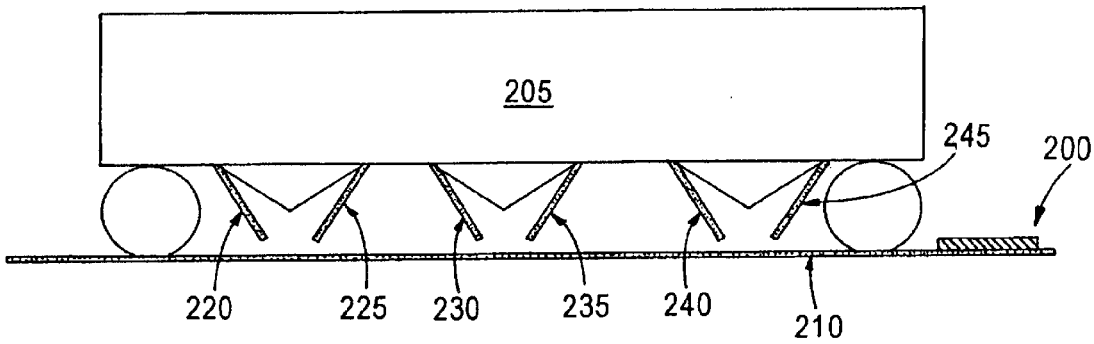
Figure 2B:
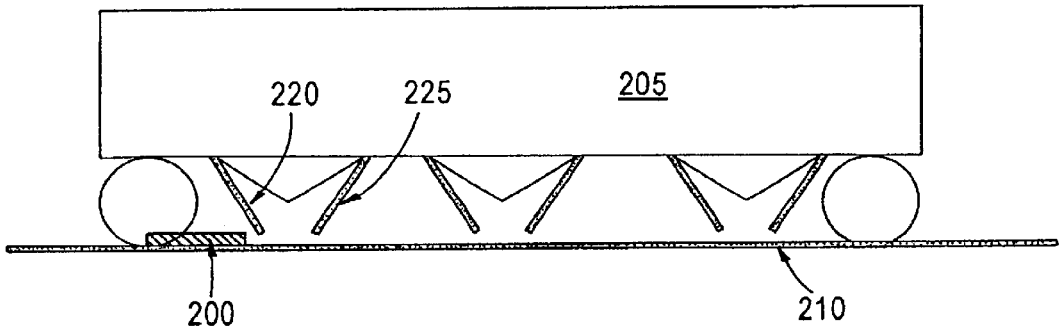
Figure 2C:
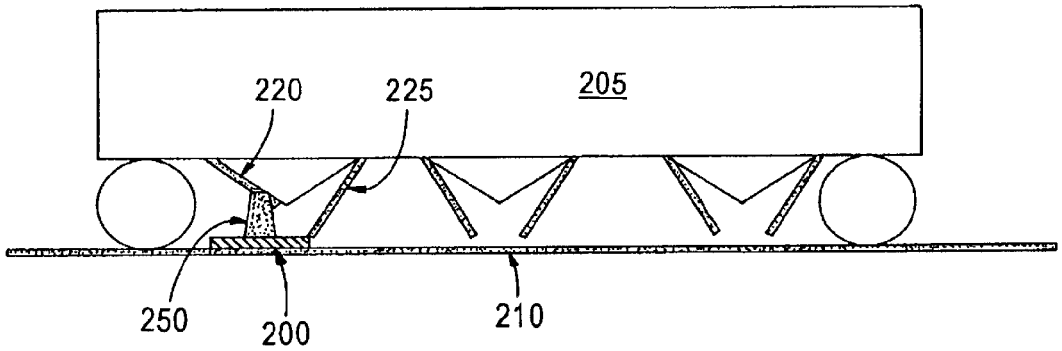
Figure 2D:
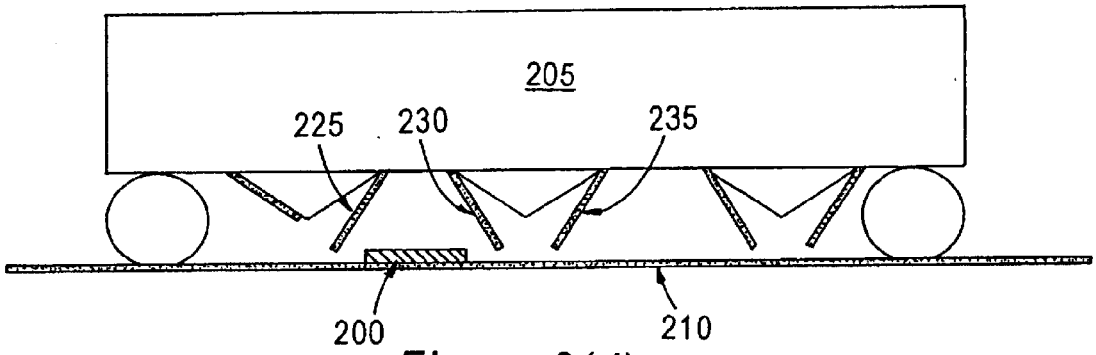
Figure 2E:
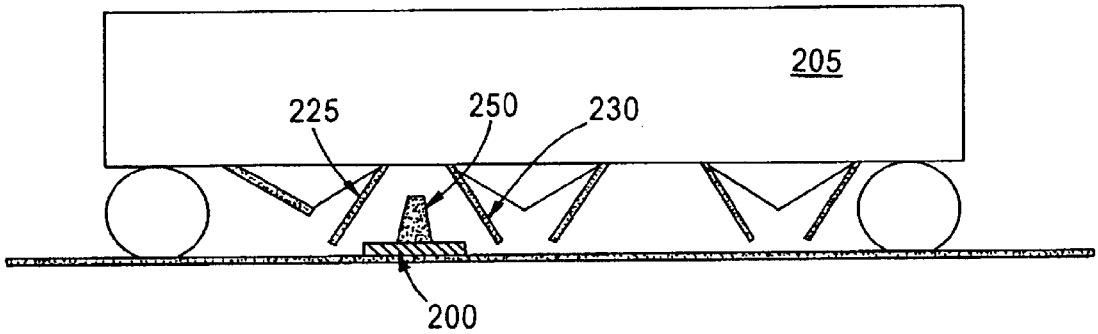
Figure 2F:
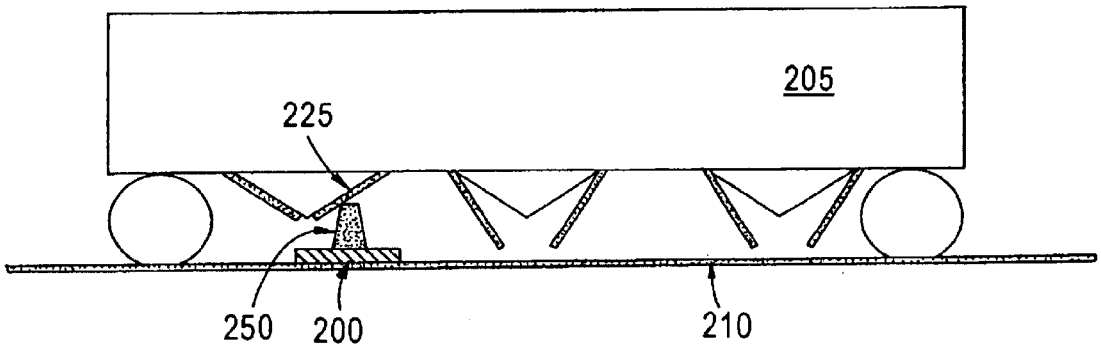
Figure 2G:
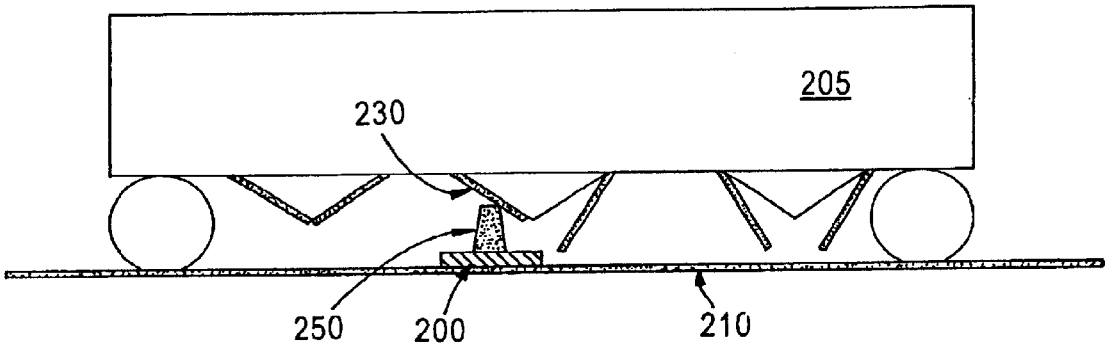
Figure 2H:
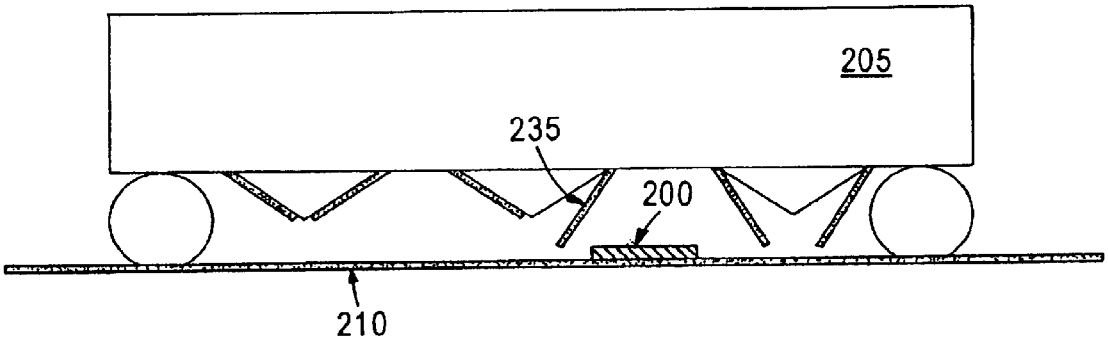
Figure 2I:
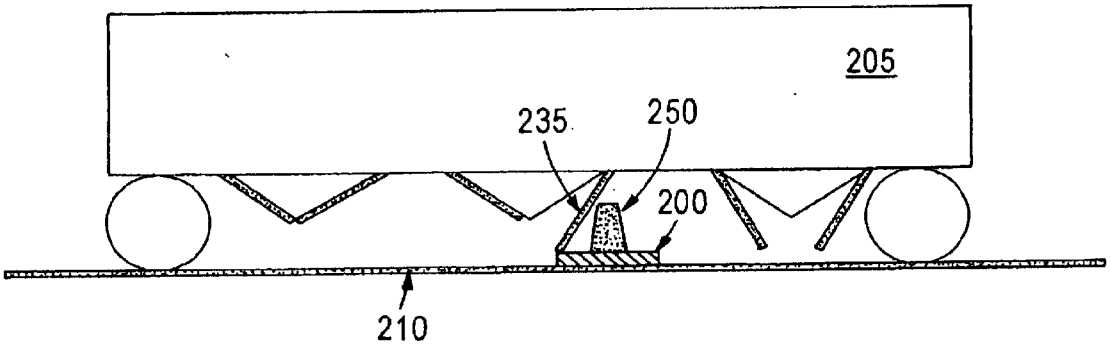
Figure 2J:
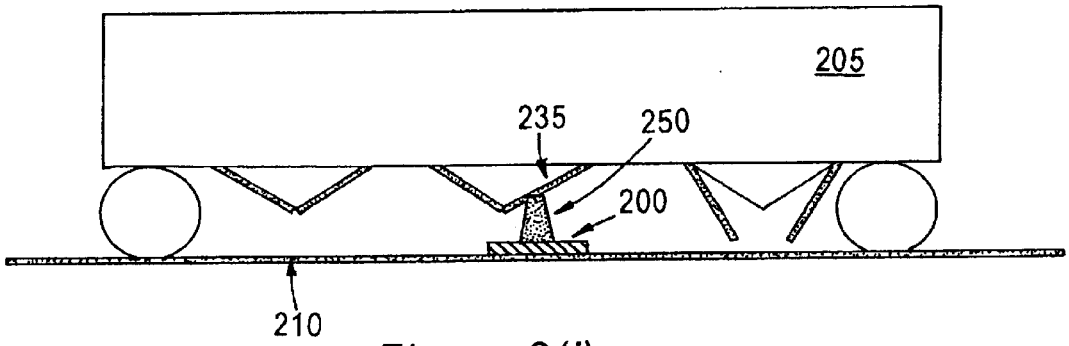
Figure 2K:
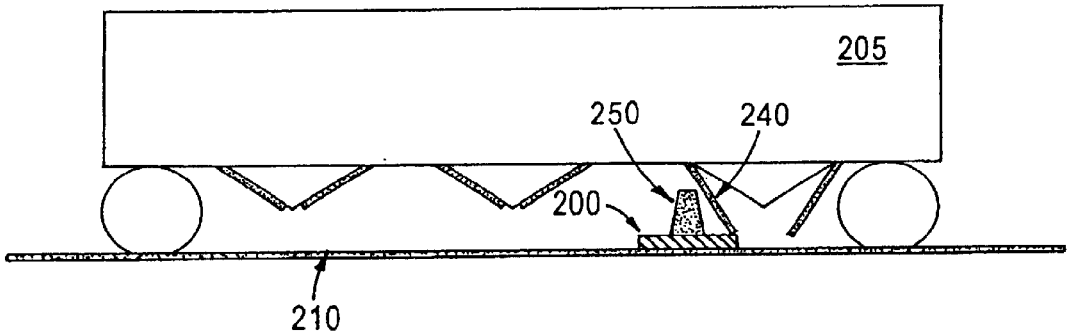
Figure 2L:
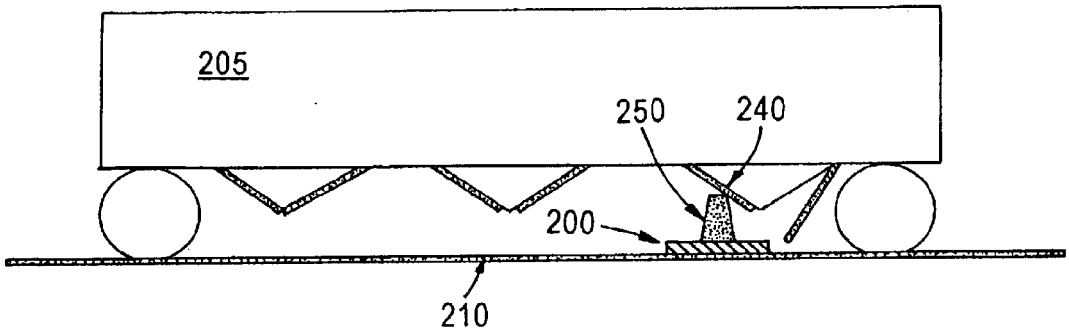
Figure 2M:
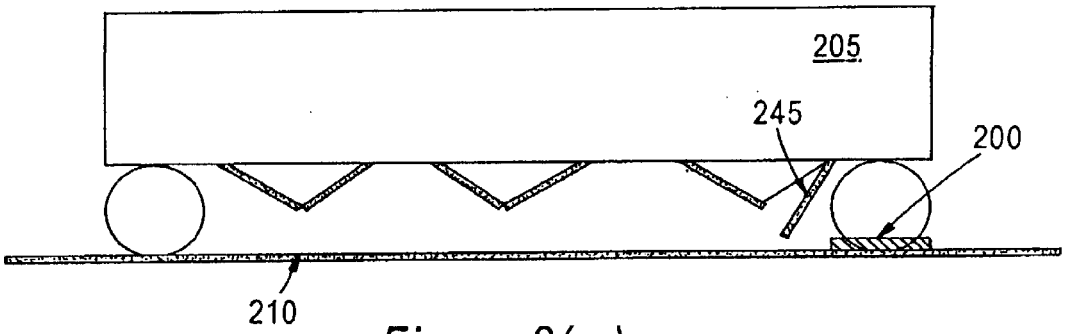
Figure 2N:
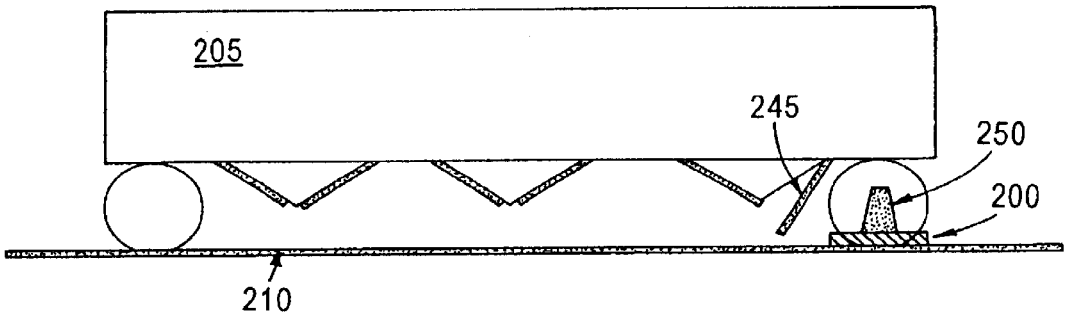
Figure 2O:
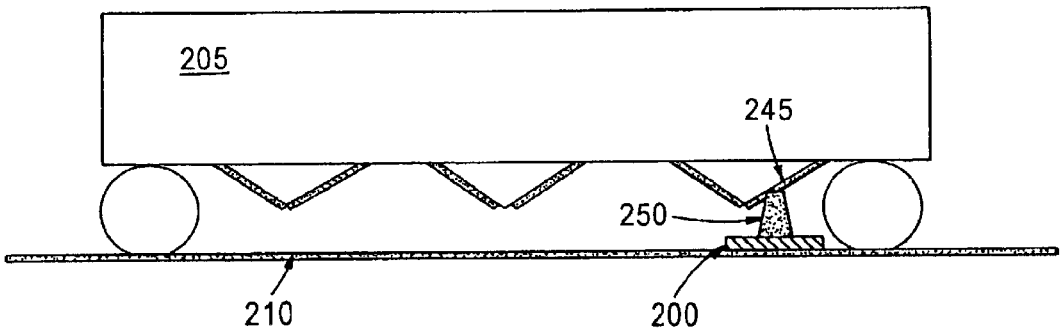
Figure 3A:
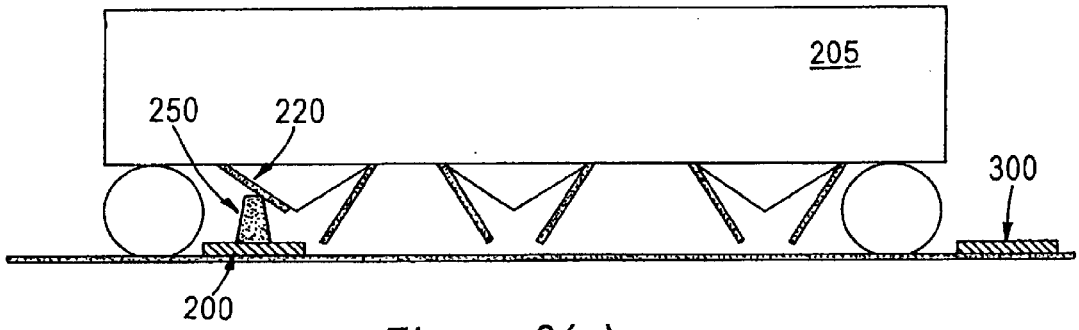
Figure 3B:
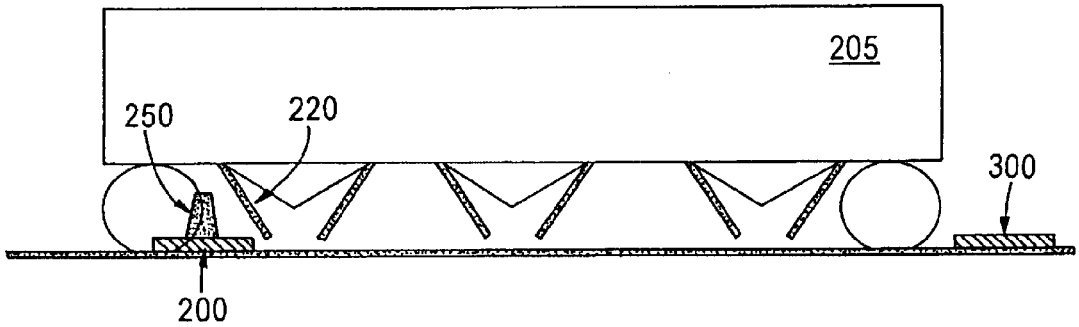
Figure 3C:
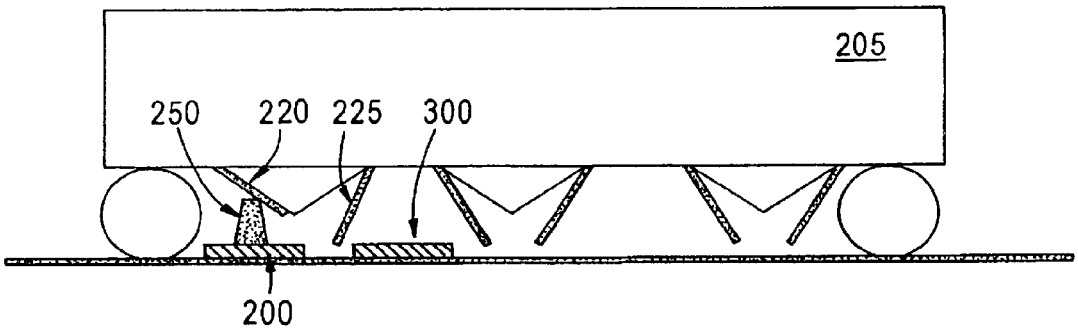
Figure 3D:
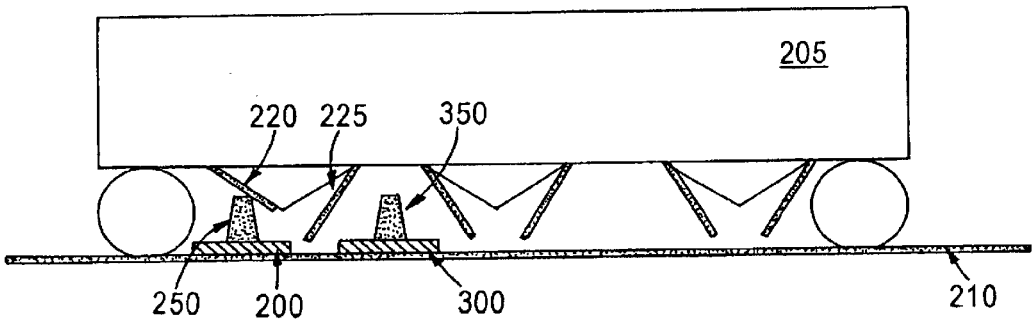
Figure 3E:
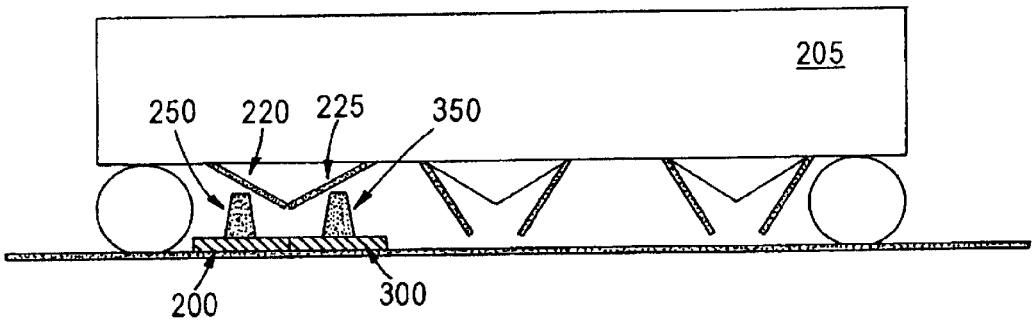
Figure 4A:
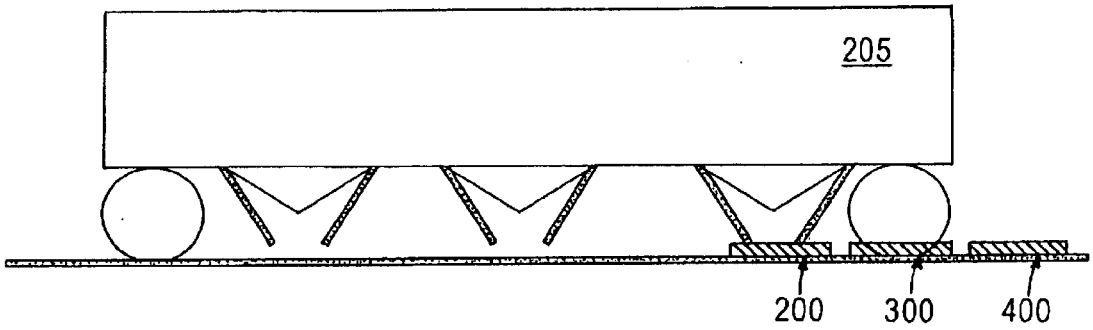
Figure 4B:
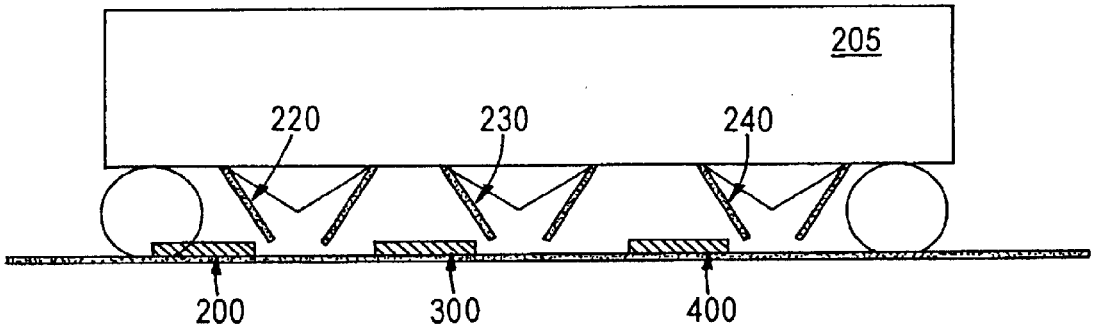
Figure 4C:
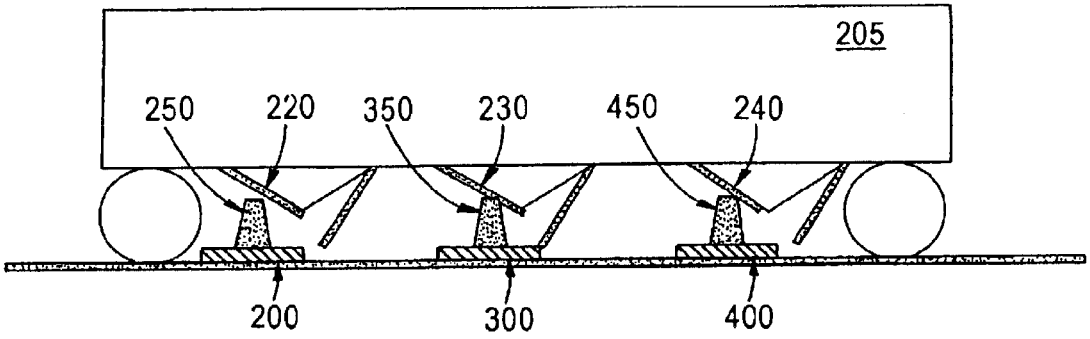
Figure 4D:
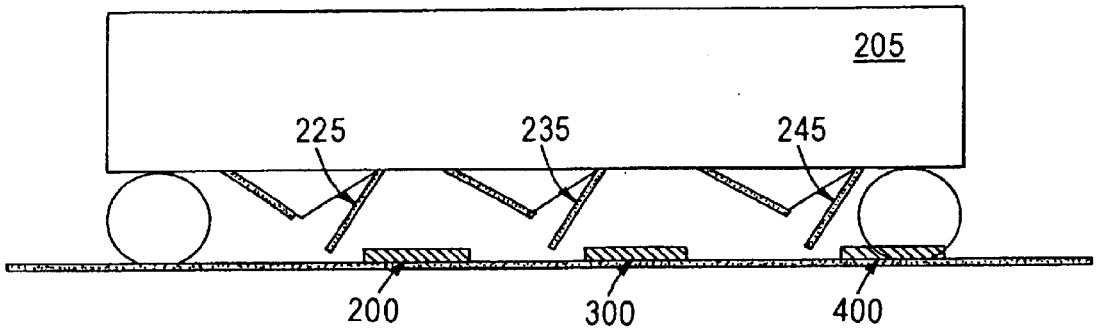
Figure 4E:
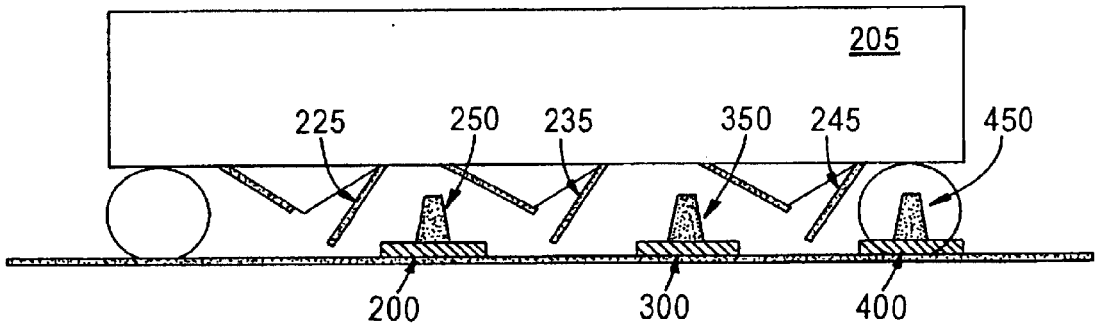
Figure 4F:
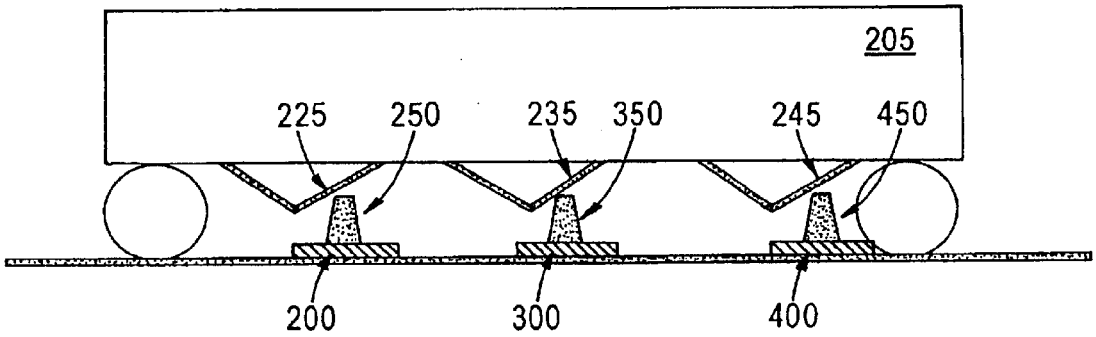

This application claims priority from U.S. Provisional Patent Application Ser. No. 60/406,342 filed on Aug. 28, 2002.

BACKGROUND

The present disclosure relates to a method and device for closing railroad car doors, particularly doors of hopper cars, which are disposed on an underside of the railroad car. Following delivery and unloading of the transported commodity (e.g., grain, coal, aggregates, etc.) through the doors, the doors hang down, sometimes vertically and sometimes at a lesser angle to the horizontal, such as about 45°. These metal doors typically weigh about 400 lbs. each and are difficult to move manually even under ideal conditions. Moreover, the doors can be exceedingly difficult to move if doors and/or hinges are worn or improperly maintained and practically impossible to completely close using conventional manual techniques when the door is bent or warped. Manual closure of the doors requires one or more workers to be under the rail car. Occasionally, workers have been injured when the doors do not close completely, fail to latch, and then swing back into the worker(s). Additionally, the physical strain of moving the heavy doors can also produce injuries.

Accordingly, various automated or semi-automated means for closing the doors of a railroad hopper car have been developed.

U.S. Pat. No. 5,299,508 to Connelly describes a rail car door closer wherein two closer assemblies are mounted adjacent to each rail of a track on a frame which passes below and between the rails. Each assembly includes a hydraulic closer jack, a hydraulic lifting jack and a hydraulic swing motor for orienting the closer jack relative to a door. The jack is extendable to contact a door and push it to a closed position. The jack assemblies can be pivoted 180° by the swing motor to close the door of the forward car and then the rearward car without having to reposition the train.

U.S. Pat. No. 5,419,262 to Turpin, Sr. describes a closer for hopper car doors including a supporting frame structure associated with the rails on which a series of hopper cars are rollingly supported together with power actuated devices that will pivot the hopper car doors from a generally vertical, downwardly extending open position which exists after the hopper car has been unloaded for engaging the hopper car doors and pivoting them about their transversely extending supporting axis to a closed, latched position. The power devices include transversely extending support shafts with a pair of laterally extending arms rigid therewith with each arm including a wheel at the outer end thereof for engaging the hopper car doors when the transverse shafts are pivoted. The transverse shafts are pivoted by hydraulically operated piston and cylinder assemblies connected to a laterally extending arm on one end portion of each shaft with activation devices being positioned in the path of movement of the hopper cars to activate the closer when the hopper car doors are in appropriate position for engagement by the wheels for movement of the hopper car doors to a closed, latched position.

U.S. Pat. No. 4,120,412 to Miller et al. describes a trackside door closing arrangement for closing the swinging doors of a railway hopper car includes a pair of pneumatic tires and wheels mounted on a pivot arm. The tires are interconnected for rotation in concert and during engagement with the doors, swing them inwardly to a closed position.

U.S. Pat. No. 4,011,956 to Green et al. shows a side of track closure mechanism is provided for engaging and exerting an inwardly directed lateral thrust against bottom dump doors of a hopper car for hingedly moving the doors inwardly to a closed position. The actuating mechanism includes a rotating arm having actuating apparatus at one end which when placed in an index position is adapted to engage the doors of bottom dump hopper cars as they move along a track adjacent to which the closure mechanism is positioned.

However, the aforementioned methods suffer from various disadvantages. For example, U.S. Pat. No. 5,299,508 to Connelly requires the train to move multiple times relative to the fixed door closer assembly to close all of the car doors, which is slow and time consuming.

SUMMARY

An object of the present concepts is to provide a means for closing doors, particularly multiple doors, of a stationary rail car. This means for closing doors must supply sufficient force to close dirty, damaged, bent, warped and/or frozen doors so that manual assistance is not necessary.

Another object of the present concepts is to avoid the risk of injuries resulting from manually closing doors and eliminate the need for a worker to be under the rail car to close the doors.

Still another object is to perform the closure operations quickly, preferably faster than the manual method employing two workers with bars.

In one aspect, there is provided a rail car door closer, comprising a movable base having a rotatable member rotationally disposed thereon, the movable base being coupled with a drive system configured to translate the movable base along a rail or a track disposed adjacent a railroad track rail. A means for securing the rotatable member in a substantially upright position is also provided. When the rotatable member is in the substantially upright position, it is positioned vertically to contact an open rail car door and, upon movement of the movable base to a position adjacent and beneath the open rail car door, the rotatable member contacts the open rail car door and subsequently moves the open rail car door in correspondence with a movement of the movable base.

In another aspect, the rail car door closer is provided with an actuating device adapted to rotate the rotatable member between a raised position and a lowered position.

In yet another aspect, there is provided a method of closing an open rail car door of a rail car disposed on a railroad track, including the steps of positioning a movable rail car door closing assembly comprising a rotating member along a rail disposed adjacent the railroad track and adjacent a first open rail car door, rotating the rotating member upwardly to confront the first open rail car door, and moving the movable rail car door closing assembly along the rail to force the rotating member in a closing direction of the first open rail car door and to contact and close the first open rail car door.

Other objects, features, and characteristics of the present concepts as well as the methods of operation and function of the related elements of structure, and the combination of parts and economies of manufacture, will become more apparent upon consideration of the description herein and the accompanying drawings, all of which form a part of this specification. For example, multiple closer elements may be simultaneously employed to achieve simultaneous closure of multiple rail car doors. Further, the motive force of the closer element may be freely varied between any combination of mechanical, electrical, electro-mechanical, electromagnetic, and fluid-driven drive systems.

IN THE DRAWINGS

FIG. 1 is a picture showing an example of the present concepts.

FIGS. 2(*a*)–2(*o*) depict the device of FIG. 1 utilized to close a plurality of rail car doors in accord with a method based on the present concepts.

FIGS. 3(*a*)–3(*e*) depicts example of the present concepts comprising a plurality of the devices of FIG. 1, wherein the plurality of devices are used in combination.

FIGS. 4(*a*)–4(*f*) depicts yet another example of the present concepts comprising a plurality of the devices of FIG. 1, wherein the plurality of devices are used in combination.

Figure 5A:
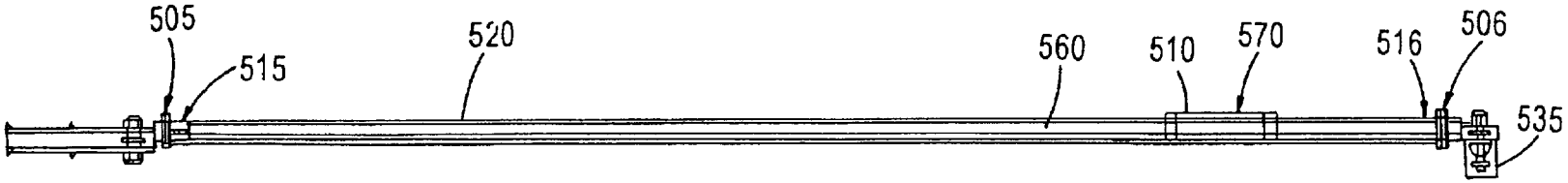
Figure 5B:
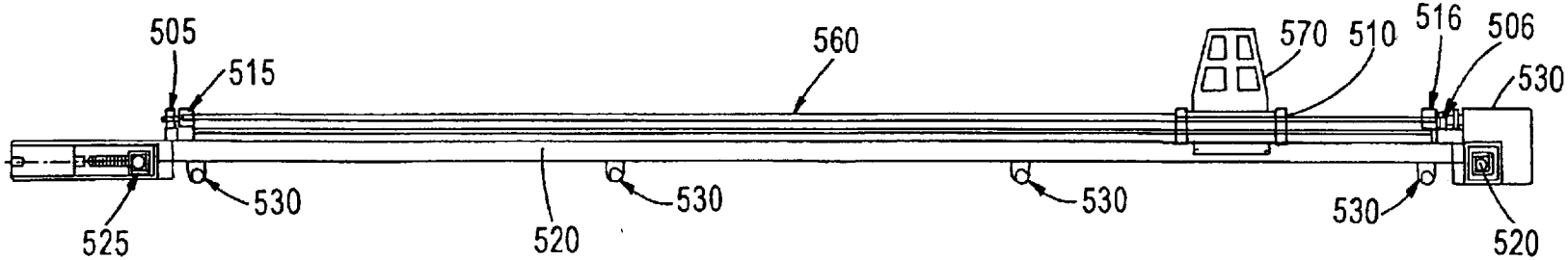
Figure 5C:
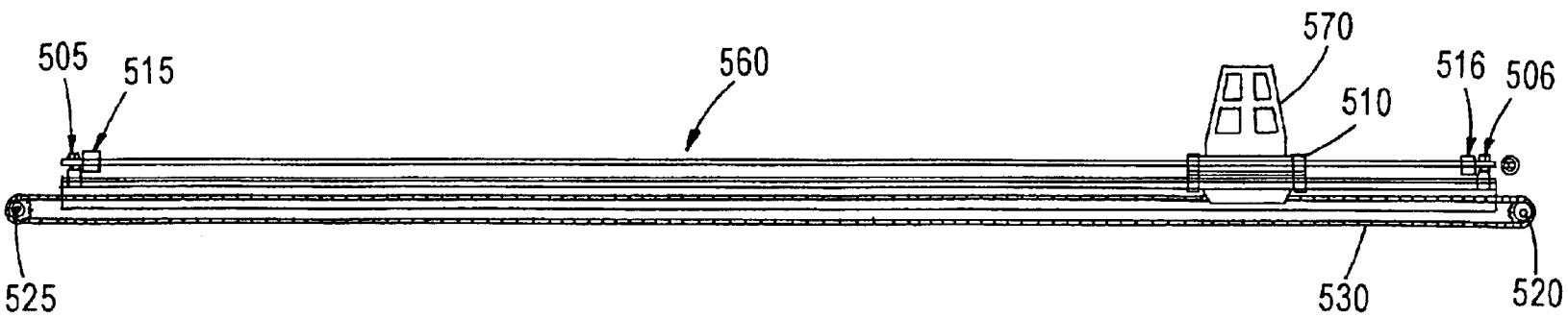
Figure 6B:
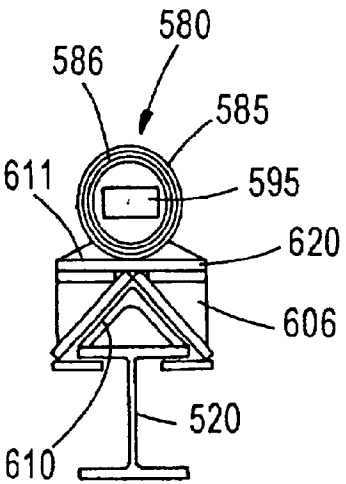
Figure 6A:
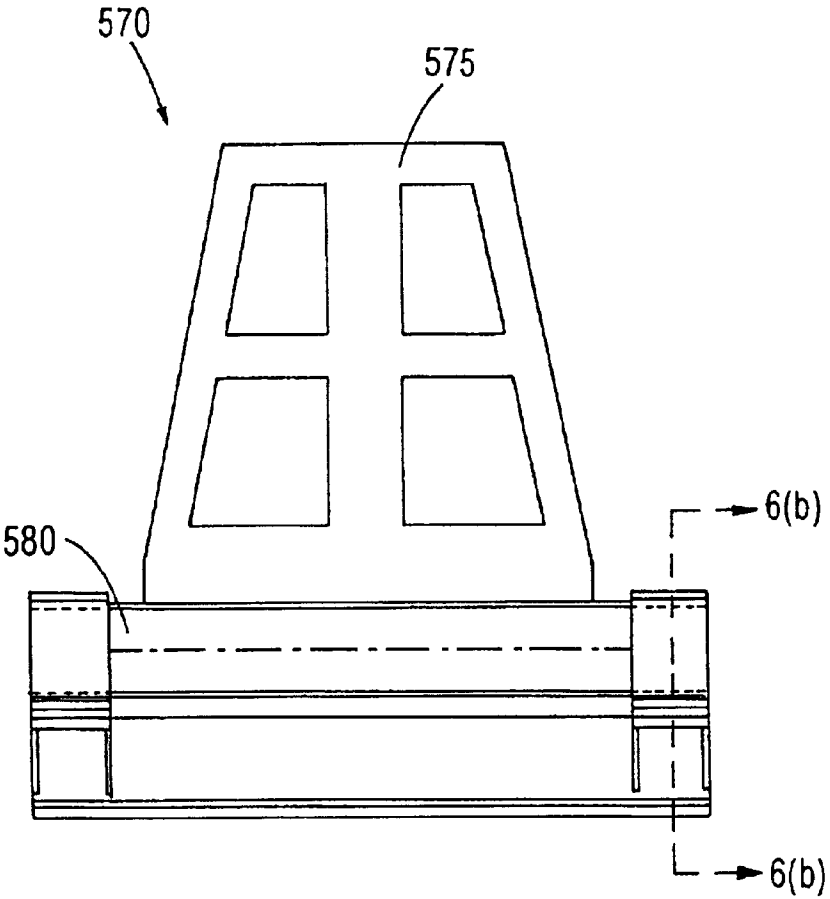
Figure 6D:
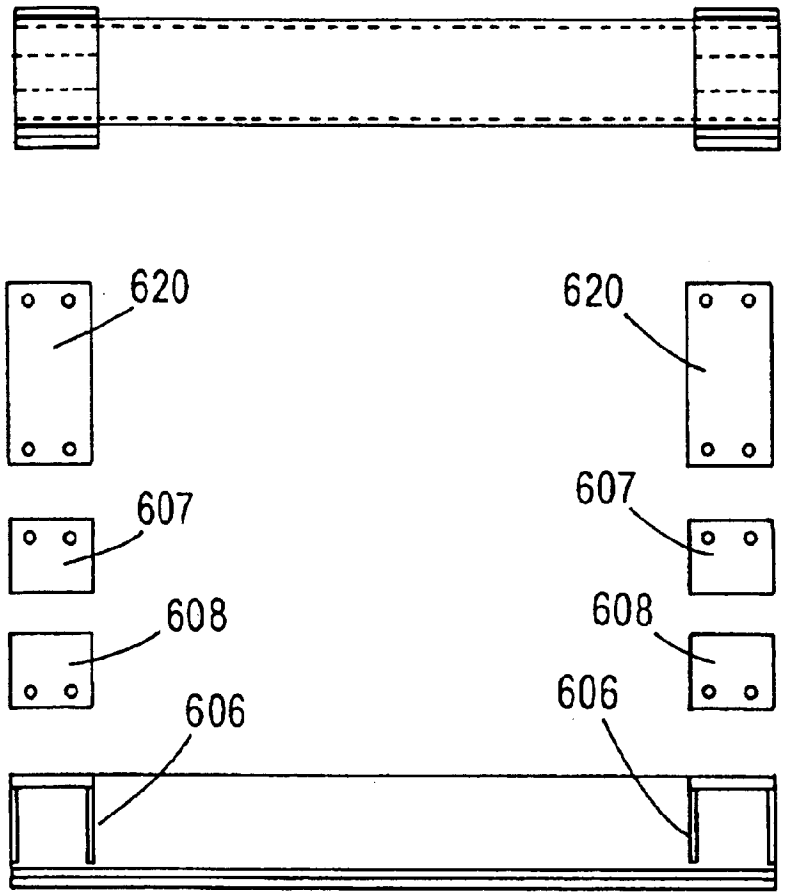
Figure 6C:
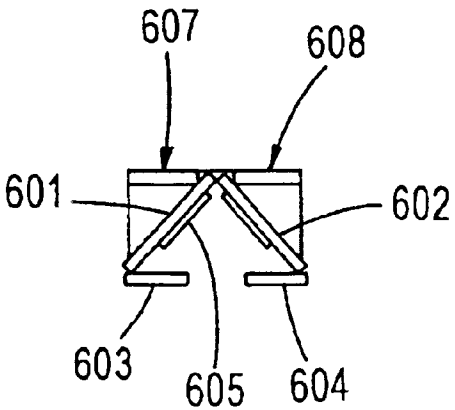

FIGS. 5(*a*)–(*b*) respectively show a top view and a side view of a specific embodiment of a rail car door closer in accord with the present concepts FIG. 5(*c*) is another side view of the rail car door closer 510, showing the drive chain attached to the underside of the rail car door closer.

FIGS. 6(*a*)–6(*b*) show a side view and a cross-sectional view, respectively, of a rotatable member in accord with the present concepts mounted on a rail car door closer assembly.

FIGS. 6(*c*)–(*d*) are cross-sectional and assembly views, respectively, of the rail car door closer assembly.

DETAILED DESCRIPTION

The present disclosure generally includes a rail-borne door closer for rail car doors, wherein a movable base having a rotatable member rotationally disposed thereon is disposed on a rail or track disposed adjacent a rail upon which the rail car rests. The movable base is configured to move or translate along a longitudinal direction of a rail car by virtue of a drive system coupled thereto. The rotatable member may be moved rotationally, along any selected axis of rotation, toward the rail car into a raised position and away from the rail car to a lowered position. When the rotatable member is in the raised position, it is of sufficient height to contact an open rail car door. When the movable base is moved in a longitudinal direction away from the door hinge, the motive force behind the movable base is transmitted to the door through the rotatable member to close the door. When the rotatable member is in the lowered position, the height of the rotatable member is lower than the height of the open doors. Therefore, the movable base may be freely moved forward and backward along the track or rail without contact between the rotatable member and an open rail car door.

In one aspect, shown in FIG. 1, a rail car door closer or traversing assembly 10 for closing the doors or a railroad hopper car is disposed on one side of a railroad track. The rail car door closer assembly 10 is movably provided on a track or rail 20, such as but not limited to a metal I-beam, disposed adjacent at least one rail of a railroad track.

Track 20 provides a stable surface for conveyance of the rail car door closer assembly 10 and runs parallel or substantially parallel to the railroad track. The track 20 may be coated with Teflon or may be embedded with Teflon so as to reduce a coefficient of friction thereof. The particular orientation (i.e., parallel or substantially parallel) of the rail 20 upon which the rail car door closer assemblies are borne is not particularly significant, as long as the rotatable element described herein, is able to engage and close each of the rail car doors along a length of a rail car.

The rail car door closer assembly 10 is translated along the rail or track 20 by a drive system comprising, in one aspect, a drive chain or cable 30 such as, but not limited to a #80 sealed chain, is mounted in a continuous loop substantially parallel to the railroad track. The drive chain or cable 30 is driven by a motor 40 (or engine) (herein collectively referred to as "motor" for brevity) secured to a transverse rail 45. At a distal end of the continuous loop, a 14 tooth idler sprocket is movably provided to adjust tension in the chain 30. Thus configured, the motor's rotation is transmitted to the rail car door closer assembly via the motor drive pinion (and additional gears, as desired) to the chain 30.

A wide variety of conventional motors may be used including, but not limited to, different displacement hydraulic high torque low-speed motors. One suitable motor is a Charlynn brand hydraulic motor (Model No. 119-1029) having a 29.2 cubic inch displacement/rev with approximately 705 ft-lb. torque with a motor drive pinion or 14 tooth sprocket, which produces a linear force or pull on the chain of about 3,380 lb. Another suitable motor is a Charlynn brand hydraulic motor (Model No. 119-1031) having a 57.4 cubic inch/rev displacement with approximately 2500 ft-lb. torque with a motor drive pinion or 14 tooth sprocket (2.5" radius) providing an effective torque multiplier of 4.8 is coupled with the 119-1031 motor, the combination would produce a linear force along the drive member (e.g., chain) of about 12,000 lbs, which is suitable for application to the present concepts. The smaller of the above motors provides a faster traversing speed with less closing power, which is advantageous for some applications, while the larger motor provides a greater closing power at a slightly slower speed, which is advantageous for other applications. Moreover, it is to be understood that motors other than the high torque low-speed motors could be used in accord with the present concepts with appropriate addition of conventional gearing in a manner known to those skilled in the art.

In an alternative configuration, the drive system may comprise two motors 40 disposed on the same end of the railroad rail on opposite sides of the rail, or may be disposed on opposite ends of the railroad rail on opposite sides of the rail. Each motor 40 would separately drive or pull the rail car door closer assembly in a selected direction, under the control of a conventional dual-motor control system. In still another configuration, a single motor 40 may be used in combination with a cable drum, preferably a single cable drum having a circumference sufficient to support a cable length equal or greater to the cable travel distance (e.g., 40 feet) without any overlapping of the cable upon itself, a condition which would effectively change the torque ratio change and require compensation at the take up end. This configuration is particularly beneficial in that the drive chains used in a setup employing a motor, a drive chain, and an idler sprocket or gear can be omitted in favor of cable, yielding a significant cost reduction.

The rotatable member 70 is, in one aspect, driven by a hydraulic cylinder 50 secured to transverse rail 45. The force generated by the hydraulic cylinder 50 is output to a link member 55 connected to a rotatable torque rod or bar 60 which spans a length of track or rail to be traversed by the rail car door closer and is rotatably secured at each end by conventional means such as, but not limited to, a low-friction roller bearing. The hydraulic cylinder 50 is, in one aspect, a hydraulic double-acting balanced rotary actuator 90° (Quarter turn), such as the type BRC 012 manufactured by Danfoss, is mounted at the end of rail 20 and is attached through an adaptable coupling to torsion bar 60.

Alternatively, torque bar 60 may be actuated or rotated by one or more hydraulic cylinders and/or other types of conventional actuator(s) such as, but not limited to, pneumatic cylinders or solenoids. The resultant rotation of the link member 55 and torque rod 60 is transmitted along a length of the torque rod to the closer element 70. Torque bar 60 is disposed to pass through a cavity centrally provided along the rotatable member 70 lateral or widthwise axis. Such cavity is dimensioned and shaped, along a whole of or a part of its length, to possess a cross-sectional profile corresponding to and slightly larger than that of torque bar 60. Torque bar 60 is non-circular in cross-section and may have, for example, an oval, triangular square, rectangular, pentagonal, cross-shaped, or some other polygonal shape having surfaces capable of transmitting a torque along a sliding surface.

For example, if torque bar 60 has a rectangular cross-section, the cavity receiving the torque bar could have a corresponding and slightly larger rectangular cross-sectional shape along a whole of its length. Alternatively, the cavity may comprise shaped bearing surfaces having the cross-sectional profile of the torque bar 60 provided along a portion thereof, such as at distal ends thereof (i.e., an entrance and an exit) or at a plurality of positions internal to the cavity. To minimize friction, it is preferred that bearing surfaces internal to such cavity are coated with a low-friction material, such as teflon. Conventional bearing structures, such as sliding bearings, may also be provided internally to the cavity in lieu of or in combination with any of the aforementioned bearing surfaces.

In one aspect, torque bar 60 is rotated by one or more hydraulic pistons or cylinders 50 and/or other type of actuator provided adjacent a distal end of the torque bar out of the range of travel of the movable rail car door closer, such as shown in FIG. 1. As noted above, the resultant rotation of the link member 55 is transmitted through the torque rod 60 to rotatable element 70, shown in one aspect shaped in the form of a polygonal wing. The torque rod 60 thus is configured to rotate the rotatable element 70 between a deployed or raised position (i.e., rotating in a direction away from and/or perpendicular to the ground to permit engagement with an open rail car door) and a lowered position (i.e., rotating in a direction toward and/or parallel to the ground so as to permit clearance in any direction between the rotatable member 70 and an open rail car door to and correspondingly permit movement of the rail car door closer past an open rail car door).

Broadly speaking, the rotatable member actuating means may comprise any conventional electric, mechanical, pneumatic, hydraulic, or magnetic means for effecting rotation of the closer element through a desired range of travel. Although one aspect of the invention includes a range of travel of about 90° between a substantially horizontal and a substantially vertical position, a lesser range of travel is also considered within the scope of the invention. It is sufficient that the closer element engages a rail car door in an inclined or engaged position, whether it be 45°, 60°, or 75°, for example, and that the closer element is spaced apart from the rail car door or other rail car components in a disengaged or declined position, whether it be 5°, 10°, or 30°, for example.

Still further, the present concepts include outright omission of the rotatable member actuating means. As noted above, it was desired to provide a means for closing rail car doors, no matter what the physical condition of the door to avoid the need for workers to manually close the doors using mechanical levers. This can still be accomplished even if the rotatable members themselves are manually positioned and locked in a desired position, as the mass of the rotatable member is substantially less than the mass of the rail car door (e.g., 20 lbs. vs. 400 lbs., respectively). In this embodiment, a lock or latch is required to maintain the rotatable member in a desired orientation during force application to the open rail car doors. The lock could be provided at or adjacent the joint between a base of the rotatable member and a non-rotatable portion of the rail car door closer assembly adjacent thereto.

In the simplest configuration, a lock or latch could be provided only to maintain a desired raised position of the rotatable member, leaving the rotatable member to hang down (i.e., substantially or nearly horizontal) in a lowered position when not locked in the raised position. A lock or latch could be provided at both the lowered position and the raised position, or a locking means could be provided to permit locking of the wing at a plurality of positions along a rotational range of travel, such as but not limited to a pawl and ratchet arrangement or holes provided in opposing disk plates provided at or adjacent the joint between a base of the rotatable member and a non-rotatable portion of the rail car door closer assembly adjacent thereto, wherein metal pins could be inserted through aligned holes to lock the rotatable member in place. In one aspect, the rotatable member could be provided with a leveraging means, such as handles or rods, to permit simple and rapid rotation from a first locked and disengaged position to a second locked and engaged position and vice versa. Once the rotatable member is appropriately positioned, the aforementioned motor 40 would be activated to provide the motive force necessary to close the rail car door. Although this embodiment is not as fast as the previous example, cost, maintenance, and system complexity are all reduced.

The rotatable member 70 attached to the rail car door closer assembly thus contacts a rail car door and applies the resultant force of the hydraulic motor as transmitted by the chain or cable. Even accounting for system frictional and efficiency losses, a significant percentage of the force generated by the motor 40 is transmitted to the rail car doors.

The rotatable member 70 may be of any shape, configuration, and/or material, provided such combination of shape, configuration, and material is sufficiently rigid to withstand (i.e., maintain structural integrity) repeated application of the static and dynamic forces applied thereto by the rail car doors. As shown, a preferred aspect of the projecting element is a wing shape having a wide base portion and a narrower top portion. This wing shape may, in one aspect, include cutouts to minimize the weight of the rotatable member without unduly compromising the structural integrity of the rotatable member, such as shown in FIG. 6(*a*)–6(*b*), to lessen the burden on the hydraulic cylinder 50. Although various steel compositions are suitable for the rotatable member 70 and associated rail car door closer assembly 10, other metals, alloys, and materials may be utilized including, but not limited to composite materials, with or without reinforcing fibers or elements.

The aforementioned rotatable member is rotated by a remote actuating means (i.e., the actuating means is not on the traversing assembly). In another aspect of the present concepts, the rail car door closer assembly 10 may comprise one or more "on-board" actuators configured to rotate the rotatable member in the desired directions. In such aspect, rotatable member 70 is driven by an actuator such as, but not limited to, a hydraulic cylinder, pneumatic cylinder, or solenoid, secured to the movable rail car door closer assembly 10 instead of transverse rail 45. A link member (e.g., similar to link member 55), may be connected to rotatable torque bar 60 adjacent the rotatable member as in the previous example or, alternatively, the actuator may act directly against a lateral surface of the rotatable member 70. In the latter aspect, a base of the actuator would be required to be appropriately fixed and braced to the rail car door closer assembly.

In the aspect wherein the actuator is provided "on-board" the rail car door closer assembly, a suitable motive force would be applied to the actuator by means of hoses or power cords, as appropriate to the actuator, which are configured to move with the rail car door closer assembly 10. In this configuration, the torque bar 60 is significantly shorted and mechanical strains and losses are minimized, although wear in the above-noted hoses or power cords becomes problematic. To reduce wear and increase the service life of the hoses or power cords, hose or cord jacket materials may be selected for flexibility and toughness (e.g., a polyurethane or PVC) and/or conventional flexible cord sheaths or armoring (e.g., interlocked armor) may be employed.

In the above described example, the rail car door closer assembly 10 is driven in either direction along a rail or track 20 using a chain drive or belt drive 30 connected to a motor 40 that is stationary with respect to the rail car door closer assembly. In an alternate configuration, the motor 40 may be integrated with the rail car door closer assembly 10 to provide "on-board" motive power to the rail car door closer assembly. Although this "on-board" embodiment could certainly utilize the same chain or belt drive system described above, such displacement of the motor 40 can permit realization of more significant design variations. Namely, the chain or belt drive system may itself be omitted in favor of gearing that would permit the rail car door closer assembly to "drive" itself along the rail.

One potential implementation thereof could include mating the output shaft pinion with teeth formed in or on the track or rail 20 in a rack and pinion arrangement. As the motor rotates in a desired direction, the output of the shaft is converted to linear motion along the rail 20 through the motion of the pinion gear relative to the gear teeth in the rail 20. Alternatively, the output of the motor could be directed by a pulley to a drive element, such as a V-belt, notched belt, or roller chain, to a central sprocket having a drive shaft attached thereto. The drive shaft in turn would be connected on opposite ends to geared wheels so that the forces transmitted by the rotation of the drive shaft could be equally applied to a left and a right side of the rail 20. Further, although not as practical, more exotic forms of translation such as magnetic rails and drivers (i.e., levitation), could be employed in accord with the present concepts.

The rail car door closer assembly may also include a conventional braking means to effect positive securement of the rail car door closer assembly 10 relative to the rail 20.

FIGS. 2(*a*) through 2(*o*) show successive steps wherein the movable rail car door closer assembly 10 and rotatable member 70 depicted in FIG. 1 is used to close a plurality of doors on a hopper car. As shown in FIG. 2(*a*), the movable rail car door closer assembly 200 is shown on a rail 210 adjacent a hopper car 205 which rests on railroad rails (not shown). The rotatable member is not shown in FIG. 2(*a*), and various other following figures, when disposed horizontally.

In FIG. 2(*b*), movable rail car door closer assembly 200 is translated along rail 210 to a position adjacent a first rail car door. In FIG. 2(*c*), the rail car door closer assembly 10 rotatable member 250 is activated and rotated to a substantially vertical position so as to be engagable with door 220. The rail car door closer assembly 200 is then linearly translated along rail 210 (rightwardly as shown) to place the rotatable member 250 in contact with the door. The rail car door closer assembly 200 is then further linearly translated along rail 210 (rightwardly as shown) to rotate the door 220 upwardly to a closed position by imparting the linear translation force of rail car door closer assembly 200 to the door 220 through the rotatable member 250. Once door 220 is closed, the rail car door closer assembly 200 may be linearly translated slightly backward along rail 210 (leftwardly as shown) to completely break contact between the door 220 and the rotatable member 250 to facilitate rotation of the rotatable member 250 back toward the horizontal position (or other suitable position) to permit the rail car door closer assembly 200 to linearly translate along rail 210 to the right and under door 225, as shown in FIG. 2(*d*).

In FIG. 2(*e*), rail car door closer assembly rotatable member 250 is activated and rotated to a substantially vertical position so as to be engagable with doors 225 and 230. The rail car door closer assembly 200 is then linearly translated along rail 210 (leftwardly as shown) to place the rotatable member 250 in contact with door 225. The rail car door closer assembly 200 is then further linearly translated along rail 210 (leftwardly as shown) to rotate door 225 upwardly to a closed position by imparting the linear translation force of rail car door closer assembly 200 to the door 225 through the rotatable member 250, as shown in FIG. 2(*f*). The rail car door closer assembly 200 is then linearly translated along rail 210 (rightwardly as shown) to place the rotatable member 250 in contact with door 230. The rail car door closer assembly 200 is then further linearly translated along rail 210 (rightwardly as shown) to rotate door 230 upwardly to a closed position by imparting the linear translation force of rail car door closer assembly 200 to door 230 through rotatable member 250, as shown in FIG. 2(*g*). Once both doors 225 and 230 are closed, rail car door closer assembly 200 may be linearly translated slightly backward along rail 210 (leftwardly as shown) to break contact between door 230 and rotatable member 250 and facilitate rotation of the rotatable member 250 back toward the horizontal position (or other suitable position) to permit rail car door closer assembly 200 to further linearly translate along rail 210 to the right and under door 235, as shown in FIG. 2(*h*).

This process may be repeated as many times as necessary, such as shown in related FIGS. 2(*i*)–2(*o*) to close all rail car doors for one or more rail cars.

It is noted that, in typical railcar door pairs, a first door (e.g., 225) possesses a latching means that holds the first door in a substantially closed position, while the second door (e.g., 230) is pivoted to a closed position. The second door, upon substantial closure (within a few degrees of full closure), abuts against and latches to the first door. Full closure of the second door substantially simultaneously closes and securely locks both the first door and second door in place. This could present a problem in situations wherein the first door is unable to securely latch in a substantially closed position, for whatever reason.

FIGS. 3(*a*)–3(*e*) show an aspect of the invention able to address the situation where the first door of a railroad door pair does not securely latch in the substantially closed position. As shown in FIG. 3(*a*), rail car door closer assembly rotatable member 250 is activated and rotated to a substantially vertical position so as to be engagable with door 220. The rail car door closer assembly 200 is then linearly translated along rail 210 (rightwardly as shown) to place the rotatable member 250 in contact with the door. The rail car door closer assembly 200 is then further linearly translated along rail 210 (rightwardly as shown) to rotate the door 220 upwardly to a (substantially) closed position by imparting the linear translation force of rail car door closer assembly 200 to the door 220 through the rotatable member 250.

However, as shown in FIG. 3(*b*), door 220 swings back open when the force from rotatable member 250 is removed. Therefore, as shown in FIG. 3(*c*), rail car door closer assembly 200 and rotatable member 250 are again positioned to (substantially) close door 220, as noted above. However, prior to disengagement of rotatable member 250 from door 220, rail car door closer assembly 300 is activated and linearly translated along another rail 211 situated on an opposite side of the railroad track to a position adjacent door 225. Rotatable member 350 is activated and rotated to a substantially vertical position so as to be engagable with door 225, as shown in FIG. 3(*d*). The rail car door closer assembly 300 is then linearly translated along rail 211 (leftwardly as shown) to place the rotatable member 350 in contact with door 225. The rail car door closer assembly 300 is then further linearly translated along rail 211 (leftwardly as shown) to rotate door 225 upwardly to a substantially closed position by imparting the linear translation force of rail car door closer assembly 300 to the door 225 through the rotatable member 350. In this substantially closed position, a latch on door 225 engages or catches a mating component on door 220. Additional leftward translation of rail car door closer assembly 300 along rail 211 rotates door 225 slightly to a fully closed and locked position, wherein movement of door 225 to the fully closed position simultaneously rotates door 220 to a fully closed position.

In an alternative configuration, the rail car door closer assemblies 200, 300 could be disposed on a single rail (e.g., 210), with the obvious constraint that the rail car door closer assemblies cannot pass each other. In one aspect, the actuating means for rotatable members 250, 350 comprises separate rotatable torque bars for each of the rail car door closer assemblies 200, 300, which could rotate in the same or opposite directions. In yet another configuration, "on-board" actuating elements may be provided for each of the rail car door closer assemblies 200, 300. Thus, the rotatable member actuating means 250, 350, inclusive of any conventional electric, mechanical, pneumatic, hydraulic, or magnetic means for effecting rotation of the closer element through a desired range of travel, may permit utilization of a common rail 210 for multiple rail car door closer assemblies 200, 300. Thus, in a single rail 210 embodiment, each of the rail car door closer assemblies 200, 300 could utilize common or separate drive systems, such as separate motors and drive members (e.g., chains, belts, cables) or a single motor with a clutch configured to selectively apply power to (e.g., rotate) or remove power to a selected drive member.

FIGS. 4(*a*)–4(*f*) show still another aspect of the invention employing multiple rail car door closer assemblies 200, 300, and 400. Rail car door closer assemblies 200, 300, 400 are linearly translated (rightwardly as shown) along either a common rail 210 or more than one rail (e.g., 210, 211) to place each rotatable member 250, 350, 450 adjacent a respective one of doors 220, 230, 240, as shown in FIG. 4(*b*). The rail car door closer assemblies 200, 300, 400 are then further linearly translated along a respective rail 210, 211 as applicable (rightwardly as shown) to substantially simultaneously rotate doors 220, 230, 240 upwardly to a (substantially) closed position by imparting the linear translation force of rail car door closer assemblies 200, 300, 400 to doors 220, 230, 240 through respective rotatable member 250, 350, 450, as shown in FIG. 4(*c*).

In FIG. 4(*d*), rail car door closer assemblies 200, 300, 400 are translated rightwardly along a respective rail 210, 211 as applicable, with the respective rotatable members 250, 350, 450 in a retracted or declined position, until they are adjacent a respective one of doors 225, 235, and 245. Rail car door assembly rotatable members 250, 350, 450 are then activated and rotated to a substantially vertical position so as to be engagable with the doors, as shown in FIG. 4(*e*). The rail car door assemblies 200, 300, 400 are then linearly translated along a respective rail 210, 211 as applicable (leftwardly as shown) to place the rotatable members 250, 350, 450 in contact with the respective doors 225, 235, and 245. The rail car door closer assemblies 200, 300, 400 are then further linearly translated along a respective rail 210, 211 as applicable (leftwardly as shown) to rotate doors 225, 235, and 245 upwardly to a fully closed position.

In such multiple rail car door closer assembly (e.g., 200, 300) embodiments, multiple drive units may advantageously be utilized. In the aspect of the concepts disclosed herein, a remote motor (i.e., not on a rail car door closer assembly) is used to power a chain or belt drive, separate motors may be provided on either side of the rail so that the rail itself separates the chain or belt drives to prevent fouling of the chains or belts. With additional rail car door closer assemblies (e.g., 400), the rail may be specially configured with additional webbing or ribbing to provide separation of the drive chains or belts. Alternatively, a multiply geared single motor may be used with a plurality of engagable/disengagable driving gears for respective rail car door closer assemblies.

Control of the rail car door closer assembly (e.g., 10) may be achieved using conventional and basic controllers configure to permit a technician to move the rail car door closer assembly back and forth along the track or rail 20 and to raise and lower the rotatable member 70. If multiple rail car door closer assemblies are used (e.g., 200, 300), the control system can include a multiplexing circuit to permit selection of one or more rail car door closer assemblies at one time. Safety features may also be implemented, such as a spring-loaded dead-man safety switch can be incorporated into the control system to regulate the power supply to the motor(s) and/or hydraulic supply, to isolate such supplies if the switch is not depressed. Multiple dead-man switches may also be included, so as to require technicians on opposite sides of the railroad track to simultaneously press the spring-loaded switches to enable operation of the system, while a single control panel would be permitted to control the movement and operation of the rail car door closer assembly or assemblies. Such redundancy would ensure that personnel on each side of the railroad track are ready for operation of the rail car door closer assembly.

In the embodiment of the invention depicted in FIGS. 2(*a*)–2(*o*), which has been tested, the door closer of the invention is able to close all six doors on a hopper car in less than half of the time of the current method (two men with bars).

Returning to the example shown in FIG. 1, FIGS. 5(*a*)–(*b*) respectively show a top view and a side view of a specific embodiment of a rail car door closer 510 in accord with the present concepts, showing overall dimensions of the device. FIG. 5(*c*) is another side view of the rail car door closer 510, showing drive chain 530 attached to the underside of the rail car door closer 510 and routed around motor pinion 520 and idler sprocket 525.

In the illustrated aspect, a 1½"×3" rectangular bar is provided to serve as the torque bar 660 and is centrally disposed over the selected track or rail 520, a W6×25# beam. The torque bar 660 is rotationally disposed between two bearings 505, 506, such as pillow block bearings, or similar rotatable elements through couplings 515, 516 having a slot to receive the ends of the 1½"×3" rectangular bar and having a shaft to couple with the bearings.

As shown in FIG. 5(*b*), the center to center distance between the motor 530 pinion 520 and the idler sprocket 525 is 36 feet and the length of the torque bar 560 is 35 feet. Idlers 530 are also disposed along a length of the rail 520 at a spacing of 11 feet, with the end idlers being arbitrarily spaced 1 foot from the respective ends of the motor 535 housing 530 and idler sprocket 525 housing. The spacing of the idlers 530 may be varied in freely in a manner known to those skilled in the art so as to maintain appropriate spacing and/or tension in the drive chain or cable 530. In the illustrated example, the idlers are each 4¾" OD rollers having a length of 4½" made from 4140 steel rotatably mounted on a vertical ½" thick plate via a 1" shaft, such as a bolt.

FIGS. 6(*a*)–6(*b*) show a side view of rotatable member 570 mounted on a rail car door closer assembly 510 and an adjoining cross sectional view taken along line A—A. The upper portion of the rotatable member 570, hereinafter referred to as polygonal wing 575, is made from 1" plate steel. Polygonal wing 570 is formed in the illustrated example with a top length of 1'3", a bottom length of 2'0", and a height of slightly over 1'10" from the base, where the polygonal wing 570 connects to the base portion 580 of the rotatable member 570. In one aspect, the base portion 580 comprises, at either end, outer cylinders 585 forming bushings or journal bearings are formed with a 5" OD and a length of about 4". having a second metal cylinder 586 (ID of 4⅜"; OD of 5") press-fit therein. A metal bar 586 having a length of 2'3⅞" is rotatably disposed within the bushings 585. Metal bar 576 possesses an OD of 4⅜" or slightly higher in a central portion thereof and an OD of about 4" from the ends the of metal bar to a point inwardly disposed about 4" to permit sliding rotational engagement of the outer ends with the bushings. An inner portion of the metal bar defines a rectangular opening 595 having a width of 3.0625" and a height of 1.5625" to slidingly receive and support the torque bar 560.

In the illustrated example, bushings 585 are secured to rail car door opener assembly 510, as shown in FIG. 6(*b*). Detailed views thereof are shown in FIG. 6(*c*) and FIG. 6(*d*). FIG. 6(*c*) shows the carriage of the rail car door closer assembly 510 including left side plate 601, right side plate 602, left bottom plate 603, right bottom plate 604, bearing members 605, ribs 606, and left and right upper plates 607, 608.

Left and right side plates 601, 602 are 3' in length, 5⁹⁄₁₆" in width, and ½" thick. Left and right side plates 601, 602 are disposed at an angle to one another, approximately 90° in the depicted aspect, and are arranged with the vertex at the uppermost position, as shown in FIGS. 6(*b*)–(*c*). The bearing members 605, having a width of 3" and a thickness of ³⁄₁₆" are disposed on inner surfaces of the left and right side plates 601, 602 to confront a an angular support member 610 affixed to a top surface of rail 520, such as by a partial/tack weld or a full/continuous weld, or by some other conventional affixation means. In one aspect, the bearing members 605 may comprise composite bearings selected for dry running, low coefficient of friction (CF=0.05–0.20), good sliding characteristics, and low wear and may include, for example, an ultra-high molecular weight (UHMW) polyethylene insert, or even a nylon or acetal. In another aspect, outwardly facing surfaces of the bearing members 605 may be coated with or embedded with a low-friction coating, such as Teflon (CF=0.05–0.20), and that the opposing surfaces on the angular support member 610 are also coated with a low-friction surface. Alternatively, bearing members 605 may be replaced by a planar roller bearing.

The left and right bottom plates 603, 604, are attached at an angle to left and right side plates 601, 602, respectively, by welding or other conventional attachment means. The angle and position of the attachment is selected to orient the left and right bottom plates 603, 604 parallel to and adjacent an underside of the top section of the rail 520, which is an I-beam in the present example. The left and right bottom plates 603, 604 are also disposed so as to project inwardly to confront at least a portion of the underside of the top section of the rail 520. As configured, the left and right bottom plates 603, 604 serve to provide additional stability to the rail car door closer assembly 510 against forces that would otherwise tend to rotationally or laterally displace or misalign the rail car door closer assembly 510. The left and right bottom plates 603, 604 may be installed so as to maintain a slight clearance between the plates and the underside of the top section of the rail 520 to minimize friction.

The left and right upper plates 607, 608, are attached at an angle to left and right side plates 601, 602, respectively, by welding or other conventional attachment means. The angle and position of the attachment is selected to orient the left and right upper plates 607, 608 parallel to and adjacent a top surface of the rail 520, an I-beam in the example. These plates are ½" thick, 3⅛" wide, and 4" long and span a lateral distance of 8", in combination with the attachment to the left and right side plates 601, 602. Left and right upper plates 607, 608, are also supported from below by one or more ribs 606 or similar support member. A pedestal member 620 comprising a 4"×8"×½" plate is then bolted or riveted to the left and right upper plates 607, 608 through holes provided in both the pedestal member and the underlying left and right upper plates. The rotatable member 570 comprising the wing 575 and the base portion 580 is welded or affixed to the pedestal member 620 and is laterally supported by reinforcing plates 611

In accord with the invention, all doors on a rail car can be closed without moving the rail car itself and without risk of injury to workers. Moreover, all doors on a rail car can be closed significantly faster than can be achieved by methods requiring manual closure or requirement movement of the cars.

The concepts disclosed herein can be practiced by employing conventional materials, methodology and equipment. Accordingly, the details of such materials, equipment and methodology are not set forth herein in detail. In the previous descriptions, details of some examples are set forth to provide a grounding in the present concepts to one of ordinary skill in the art. However, it should be recognized that the present concepts can be practiced without resorting to every detail specifically set forth and that the disclosed examples are capable of use in various other combinations and environments and are capable of changes or modifications thereto which would still fall within the broad scope of the concepts expressed herein.

What is claimed:

1. A rail car door closer, comprising:

a movable base having a rotatable member rotationally disposed thereon, said movable base being coupled with a drive system configured to translate the movable base along one of a rail and a track disposed adjacent a railroad rail; and a means for securing said rotatable member in a substantially upright position, wherein, in said substantially upright position, said rotatable member is positioned vertically to contact an open rail car door, and wherein, upon movement of said movable base to a position adjacent and beneath said open rail car door, said rotatable member contacts said open rail car door and subsequently moves said open rail car door in correspondence with a movement of said movable base.

2. A rail car door closer according to claim 1, further comprising an actuating device adapted to rotate said rotatable member between a raised position and a lowered position.

3. A rail car door closer according to claim 2, wherein said actuating device is disposed on said movable base.

4. A rail car door closer according to claim 1, wherein said means for securing said rotatable member in a substantially upright position comprises at least one of a lock, a latch, a pin, and an actuator.

5. A rail car door closer according to claim 4, wherein said drive system comprises a motor configured to drive at least one of a chain and a cable in a continuous loop in both a forward and a backward direction along a respective one of said rail and said track, said movable base being coupled to a respective one of said chain and cable.

6. A rail car door closer according to claim 5, wherein said drive system comprises at least one motor mounted adjacent said rail outside of a range of travel of said rail car door closer movable base along said rail, said at least one motor being configured to drive a drive member selected from the group consisting of a chain, a cable, and a belt, in both a forward and a backward direction along a respective one of said rail and said track, said movable base being coupled to said at least one drive member.

7. A rail car door closer according to claim 6, wherein said drive system comprises a plurality of motors, each of said motors being configured to drive at least one drive member selected from the group consisting of a chain, a cable, and a belt, in both a forward and a backward direction along a respective one of said rail and said track, said movable base being coupled to each of said respective drive member.

8. A rail car door closer according to any one of claims 1 or 4–7, further comprising:

a torque bar connected to said rotatable member;

an actuating device connected to said torque bar to selectively apply a torque to a torque bar;

wherein transmission of torque from said torque bar to said rotatable member rotates said rotatable member in a direction of an applied torque.

9. A rail car door closer according to claim 8, wherein said actuating device comprises one of a hydraulic, pneumatic, and electromagnetic actuator.

10. A rail car door closer according to claim 9, wherein said actuating device is a torque bar rotatably disposed adjacent said rail along a range of travel of said rail car door closer, and wherein said actuating device is mounted adjacent said rail outside of a range of travel of said rail car door closer movable base along said rail.

11. A rail car door closer according to claim 10, wherein said rotatable member comprises a through-hole in a base portion thereof, said through-hole defining an opening having a cross-section substantially corresponding in size and shape to a cross-section of said torque bar along at least a portion of said through-hole, and wherein said torque bar is enabled to slide within said through-hole and said opening.

12. A rail car door closer according to claim 10, wherein both said opening and said torque bar are rectangular in cross-section.

13. A rail car door closer according to claim 10, wherein said opening comprises at least a bottom surface having a static coefficient of friction relative to steel below 0.20.

14. A rail car door closer according to any one of claims 1 or 4–7, further comprising:

an actuating device mounted at a proximal end to said rail car door closer movable base and attached at a distal end to a lateral surface of said rotatable member, said actuating device being configured to drive said distal end between a first position and a second position, wherein movement of said distal end of said actuating device selectively applies a torque to said rotatable member and rotates said rotatable member in a direction of an applied torque.

15. A rail car door closer according to claim 13, wherein said actuating device comprises one of a hydraulic, pneumatic, and electromagnetic actuator.

16. A rail car door closer, comprising:

a movable base having a rotatable member rotationally disposed thereon, said movable base being coupled with a drive system configured to translate the movable base along one of a rail and a track disposed adjacent a railroad rail; and an actuating device adapted to rotate said rotatable member between a raised position and a lowered position;

wherein, in said substantially upright position, said rotatable member is positioned vertically to contact an open rail car door, and wherein, upon movement of said movable base to a position adjacent and beneath said open rail car door, said rotatable member contacts said open rail car door and subsequently moves said open rail car door in correspondence with a movement of said movable base.

17. A rail car door closer according to claim 16, wherein said drive system comprises a motor mounted adjacent said rail outside of a range of travel of said rail car door closer movable base along said rail, and wherein said motor is connected to a drive member selected from the group consisting of a chain, a cable, and a belt, by a connection member attached to an output shaft of said motor to drive said drive member in one of a forward and a backward direction in accord with a direction of rotation of said motor output shaft along a respective one of said rail and said track, said movable base being coupled to said at least one drive member.

18. A rail car door closer according to claim 17, further comprising:

a torque bar rotatably disposed adjacent said rail along a range of travel of said rail car door closer, said torque bar being connected to said rotatable member; and an actuating device comprising one of a hydraulic, pneumatic, and electromagnetic actuator, mounted adjacent said rail outside of a range of travel of said rail car door closer movable base along said rail and connected to said torque bar to selectively apply a torque to a torque bar, wherein transmission of torque from said torque bar to said rotatable member rotates said rotatable member in a direction of an applied torque.

19. A rail car door closer according to claim 18, wherein said rotatable member comprises a through-hole in a base portion thereof, said through-hole defining an opening having a cross-section substantially corresponding in size and shape to a cross-section of said torque bar along at least a portion of said through-hole, and wherein said torque bar is enabled to slide within said through-hole and said opening.

20. A rail car door closer according to claim 17, wherein a plurality of said movable bases having a rotatable member rotationally disposed thereon are disposed to translate along said rail.

21. A method of closing an open rail car door of a rail car disposed on a railroad track, comprising the steps of:

positioning a movable rail car door closing assembly comprising a rotating member along a rail disposed adjacent said railroad track and adjacent a first open rail car door;

rotating said rotating member upwardly to confront said first open rail car door; and moving said movable rail car door closing assembly along said rail to force said rotating member in a closing direction of said first open rail car door and to contact and close said first open rail car door.

22. A method of closing an open rail car door of a rail car disposed on a railroad track according to claim 21, further comprising the steps of:

rotating said rotating member downwardly away from the closed rail car door to permit said movable member to be translated along said rail without interference, repositioning said movable rail car door closing assembly along said rail adjacent a second open rail car door;

rotating said rotating member upwardly to confront said second open rail car door; and moving said movable rail car door closing assembly along said rail to force said rotating member in a closing direction of said second open rail car door and to contact and close said second open rail car door.

23. A method of closing an open rail car door of a rail car disposed on a railroad track according to claim 21, further comprising the steps of:

positioning a second movable rail car door closing assembly comprising a rotating member along said rail adjacent a second open rail car door comprising a latch, said second open rail car door being disposed adjacent to and opening toward said first open rail car door;

rotating said rotating member upwardly to confront said second open rail car door;

moving said second movable rail car door closing assembly along said rail to force said rotating member thereof in a closing direction of said second open rail car door and to contact and move said second open rail car door in a closing direction;

holding said second open rail car door in a substantially closed position; and moving said movable rail car door closing assembly along said rail to force said rotating member thereof in a closing direction of said first open rail car door and to contact and move said first open rail car door in a closing direction to a substantially closed position, whereupon said second open rail car door latches to said first open rail car door.

* * * * *